US010465298B1

(12) United States Patent
Ramotowski

(10) Patent No.: US 10,465,298 B1
(45) Date of Patent: Nov. 5, 2019

(54) CATHODIC DEBONDING PREVENTION METHOD AND APPARATUS

(71) Applicant: The United States of America as represented by the Secretary of the Navy, Newport, RI (US)

(72) Inventor: Thomas S Ramotowski, Tiverton, RI (US)

(73) Assignee: The United States of America as represented by the Secretary of the Navy

( * ) Notice: Subject to any disclaimer, the term of this patent is extended or adjusted under 35 U.S.C. 154(b) by 0 days.

(21) Appl. No.: 16/137,698

(22) Filed: Sep. 21, 2018

(51) Int. Cl.

| | |
|---|---|
| ***H01R 9/05*** | (2006.01) |
| ***C23F 13/16*** | (2006.01) |
| ***C23F 13/20*** | (2006.01) |
| *H01R 13/523* | (2006.01) |
| *H01R 4/72* | (2006.01) |
| *H01R 43/24* | (2006.01) |

(52) U.S. Cl.
CPC ..... *C23F 13/16* (2013.01); *C23F 13/20* (2013.01); *H01R 9/05* (2013.01); *H01R 4/72* (2013.01); *H01R 13/523* (2013.01); *H01R 43/24* (2013.01)

(58) Field of Classification Search
CPC ..... H01R 4/72; H01R 13/523; H01R 43/24
See application file for complete search history.

(56) References Cited

U.S. PATENT DOCUMENTS 5,942,333 A * 8/1999 Arnett ..... B05B 7/20 428/461
7,141,150 B1 * 11/2006 Welch ..... C23F 13/02 204/401

* cited by examiner

*Primary Examiner* — Tho D Ta
(74) *Attorney, Agent, or Firm* — James M. Kasischke; Michael P. Stanley

(57) ABSTRACT

A method for improving service life in a connector for joining to a cathodically protected platform includes providing a metallic connector for joining to a cable. A non-conductive coating is provided on the connector proximate the cable. A hydroxide ion diffusion distance is determined that will insure dilution of hydroxide ions to a level that will prevent damage to an encapsulant and non-conductive coating bond on the connector. A polymer encapsulant is molded around the non-conductive coating and the cable to seal the assembled cable in the connector such that the encapsulant and non-conductive coating bond is formed at a greater path distance than the determined hydroxide ion diffusion distance from any hydroxide ion source.

9 Claims, 2 Drawing Sheets

CATHODIC DEBONDING PREVENTION METHOD AND APPARATUS

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The present invention is directed to marine connectors and more particularly to a method for protecting such connectors when used with a cathodically protected object.

(2) Description of the Prior Art

FIG. 1 shows a prior art electrical connector 10 joined to a cable 12 for use in a marine environment. Cable 12 has a plurality of electrical elements 14 that terminate in a connector body 16. Connector body 16 is hollow with a back shell portion 18 and a terminal connection portion 20. An exterior surface of back shell portion 18 is covered by a non-conductive coating 22. Coating 22 is much thinner than shown in FIG. 1 and the other FIGs. herein. Coating 22 thicknesses of between 0.1 mm and 5 mm are known in the art. U.S. Pat. No. 5,942,333 to Arnett et al. provides a description of non-conductive coatings.

Connector body 16 consolidates elements 14 in the back shell portion 18 so that they can be attached to an outlet 24 mounted to a vessel 26. Terminal connector 18 can be joined to outlet 24 using many different methods. The example in FIG. 1 shows a mounting ring 28 that can be used to secure connector body 16 in outlet 24. Connector body 16 is typically made from a corrosion resistant metal; however, other anticorrosion measures are taken as described hereafter. Elements 14 shown in FIG. 1 can have many different configurations known in the art, and the depiction herein should not be limiting.

After assembly of the cable 12 with connector body 16, an encapsulant 30 is molded around non-conductive coating 22 on the exterior of back shell portion 18 in order to seal the junction between cable 12 and connector body 16. Coating 22 can be a ceramic, a polymer, or other non-conductive material. Encapsulant 30 is typically polyurethane or another polymer. Encapsulant 30 is bonded to the cable 12 and back shell portion 18 of connector body 16 and fills substantially all of the volume of this junction. Bonding of encapsulant 30 to the cable 12 and the connector body 16 is critical for preventing leakage of seawater into the region where the elements 14 extend into hollow back shell portion 18.

Corrosion of vessel 26 hull is prevented by a cathodic protection system 32. Cathodic protection system 32 can be sacrificial anodes or an induced current cathodic protection (ICCP) system. System 32 converts hull 26 from being an anode (i.e., subject to corrosion) to being a cathode (i.e., protected from corrosion). At the voltages normally used, the cathodically protected hull supports the following half-cell reaction on its exposed metal surfaces:

$$O_2+2H_2O+4e^- \rightarrow 4(OH)^- \quad (1)$$

Equation (1) does not harm the metal surface. It does, however, result in the generation of a very high pH environment immediately above the metal surface. Any conductive hardware (such as a cable connector or hull penetrator) electrically connected to the cathodically polarized metal surface can pick up the cathodic current and thus becomes cathodically polarized itself. The concentrated alkaline environment that forms immediately above cathodically polarized metal surfaces can destabilize metal-oxide layers, break metal-polymer bonds, and in some cases, attack or damage polymers directly. High pH environments are detrimental to most polymer-metal bonds. They can cause paint to fall off of cathodically polarized hardware, and they can cause polymer encapsulants such as 30 to debond from connector back shell portion 18. This often results in flooding of the connector and failure. This phenomenon is known as cathodic debonding or cathodic delamination, and it is a major cause of connector failure in the marine environment. Preventing this failure has been a subject of extensive research.

Referencing FIG. 1, cathodic debonding on outboard cable connectors proceeds inwardly from the exposed metal-polymeric encapsulant bond-line/interface 34. One prior art approach to increasing connector life is to maximize the length of the encapsulant 30 bonded to the back shell portion 18. The theory is that since debonding proceeds at a rate of distance over time, connector life is increased by increasing the bonded distance. To this end, bond-line/interface 34 is provided as close to outlet 24 and connector 10 junction as possible.

Since the required reactants for the debonding process, water and oxygen, can permeate through the polymeric encapsulant 30, and the electrons (current) come through the metal substrate, it has been a longstanding mystery as to why cathodic debonding only occurs through exposed bond lines. Cathodic debonding doesn't happen where encapsulant 30 contacts cable 12 because the cable jacket and encapsulant 30 are insulators.

Experimental testing has confirmed that cathodic debonding rates are dependent on electrolyte concentration at the region of interface 34. As the concentration of the electrolyte increases, so does the rate of debonding. The debonding rate drops to zero when the concentration of the electrolyte drops to zero. The dependence of the debonding rate on the concentration of the electrolyte is interesting, because in equation (1), the cathodic reaction that causes debonding, does not include sodium ($Na^+$) or chlorine ($Cl^-$) ions, the two most common ions comprising the electrolyte. Experimental testing also found that the debonding relationship is linear with respect to the square root of time. This suggests that a diffusion reaction is in control of the debonding rate.

A possible reason for the dependence of the debonding rate on the electrolyte concentration is that the right side of equation (1) is not charge-balanced. The cathodic debonding reaction generates negatively charged hydroxide ions ($OH^-$). These negative charges need to be cancelled out or balanced by an equal number of positive charges. The only significant source of positively charged ions is the electrolyte. Some of its positively charged metal ions ($M^+$) must migrate to the region of active debonding to provide the needed charge balance.

Analysis has determined that the $M^+$ charge balancing cations diffuse through the bond-line/interface 34 between the metal surface of the connector back shell portion 18 and encapsulant 30 to keep the actively debonding region electrically neutral. Thus, the $M^+$ ions move between connector back shell portion 18 and encapsulant 30 after a debonding front has passed through. The need for this cation migration to occur would also explain the diffusion-control of the rate of the debonding, and it also explains that cathodic debonding on outboard electronic cable connectors begins at an exposed polymeric encapsulant/metal back shell interface/bond line 34 because charged species like $M^+$ cannot diffuse through encapsulant 30 polymers. These species must diffuse through the disrupted, former bond line. The resulting equation is:

$$O_2+2H_2O+4e^-+4M^+\rightarrow 4(OH^-)+4M^+ \quad (2)$$

U.S. Pat. No. 5,942,233 to Arnett et al provides a non-conductive ceramic layer as coating 22 between the metal substrate of the connector and polyurethane over molding as a solution to the debonding problem. Non-conductive ceramic coatings are ceramic coatings that can be applied to metal parts by thermal or plasma spraying. The coating prevents electrical contact between the metal connector and the polymer over molding. Use of these coatings is based on the theory that the coating prevents cathodic debonding by shielding the polyurethane over molding from the cathodically protected connector. This prevents formation of hydroxide ions as in equation (1) because this reaction must occur on an electrically conductive surface. Incorporation of the non-conductive coating weakens the hydroxide ion concentration at the coating/over molding interface thereby extending the life of the connector; however, the coating does not fully prevent cathodic debonding.

Thus, there continues to be a need for a method of preventing debonding at polymer bond interfaces.

SUMMARY OF THE INVENTION

It is a first object of the present invention to provide a method for protecting a connector when joined to a cathodically protected platform.

Another object is to provide a method for designing marine connectors that will have longer service life when joined to cathodically protected platforms.

Accordingly, there is provided a method for improving service life in a connector for joining to a cathodically protected platform includes providing a metallic connector for joining to a cable. A non-conductive coating is provided on the connector proximate the cable. A hydroxide ion diffusion distance is determined that will insure dilution of hydroxide ions to a level that will prevent damage to an encapsulant and non-conductive coating bond on the connector. A polymer encapsulant is molded around the non-conductive coating and the cable to seal the assembled cable in the connector such that the encapsulant and non-conductive coating bond is formed at a greater path distance than the determined hydroxide ion diffusion distance from any hydroxide ion source.

BRIEF DESCRIPTION OF THE DRAWINGS

Reference is made to the accompanying drawings in which are shown an illustrative embodiment of the invention, wherein corresponding reference characters indicate corresponding parts, and wherein.

DETAILED DESCRIPTION OF THE INVENTION

Figure 1:
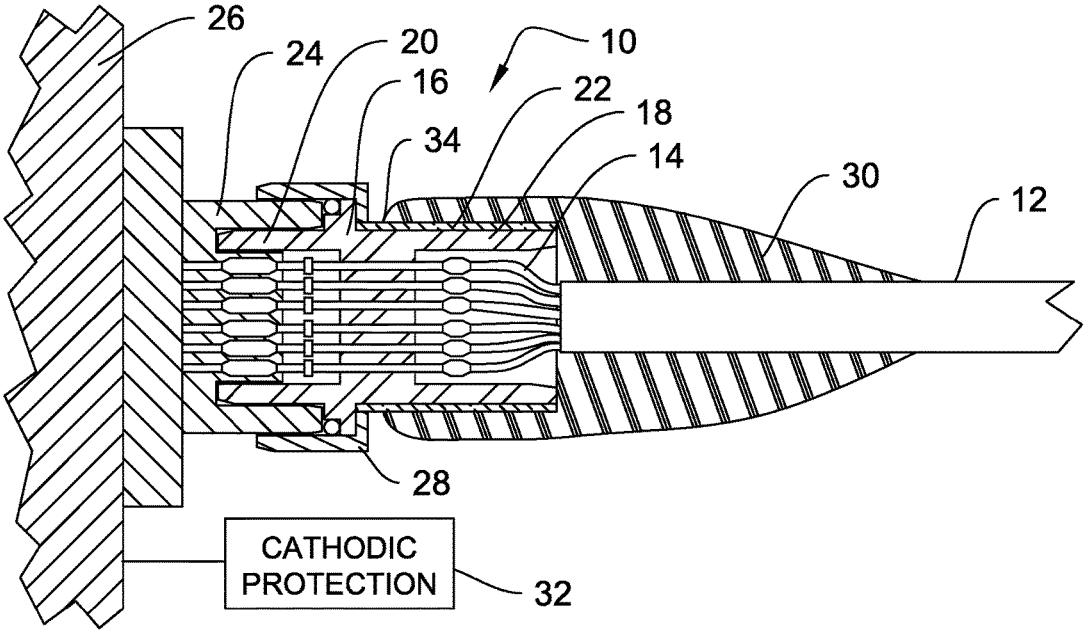
FIG. 1 (PRIOR ART)
FIG. 1 is a diagram showing a prior art connector subject to cathodic debonding.
Figure 2:
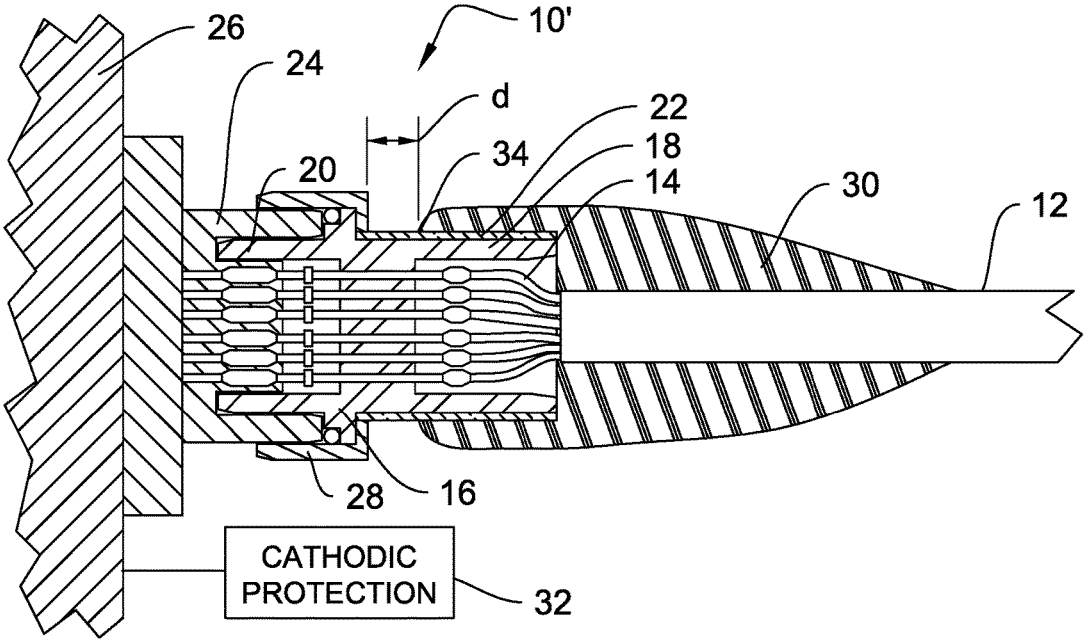
FIG. 2 is a diagram showing a first embodiment of a connector protected against cathodic debonding.

FIG. 2 suggests a method by which cathodic debonding can be stopped. If the flow of $M^+$ charge balance cations to the site of active debonding is disrupted, the cathodic debonding process slows or completely stops. This is easier than trying to stop the movement of the oxygen ($O_2$) and water ($H_2O$) needed for the cathodic delamination reaction to occur. Because oxygen and water are either uncharged or possess a small dipole, they can diffuse through polymers, whereas $M^+$ cations, being charged, cannot.

FIG. 2 shows a first embodiment of a connector 10' for avoiding or reducing cathodic debonding. As above, connector 10' is joined to a cable 12 having multiple elements 14. Connector 10' has a connector body 16 that includes a back shell portion 18 and a terminal connection portion 20. Back shell portion 18 is covered by a non-conductive coating 22. Connector 10' at its terminal connection portion 20 is joined to an outlet 24 that may be on a vessel 26 or other structure. As before, connector 10' is affixed in outlet 24 by a mounting ring 28. An encapsulant 30 is applied to the exterior of non-conductive coating 22. The vessel 26 is protected from corrosion by cathodic protection system 32.

In this embodiment, encapsulant bond-line/interface 34 is moved away from mounting ring 28 and plug 24 interface by a distance d. Distance d is a diffusion path length away from a hydroxide ion generating structure (in this case locking ring 28) that allows sufficient diffusion of ions to resist debonding. Diffusion path length d is dependent on the hydroxide ions present in the environment and the turbulence in the environment. Greater turbulence results in greater mixing and a lower hydroxide ion concentration at a given distance. Distances of 0.01 inches have been shown to be insufficient to protect from debonding. Diffusion distances of 0.5 inches have found to provide sufficient diffusion to protect encapsulant 30 from debonding. The minimum distance d can be established by experimental testing. Once further data is collected modeling can also be used to calculate a distance d that will give the necessary connector life given a particular connector design.

Figure 3:
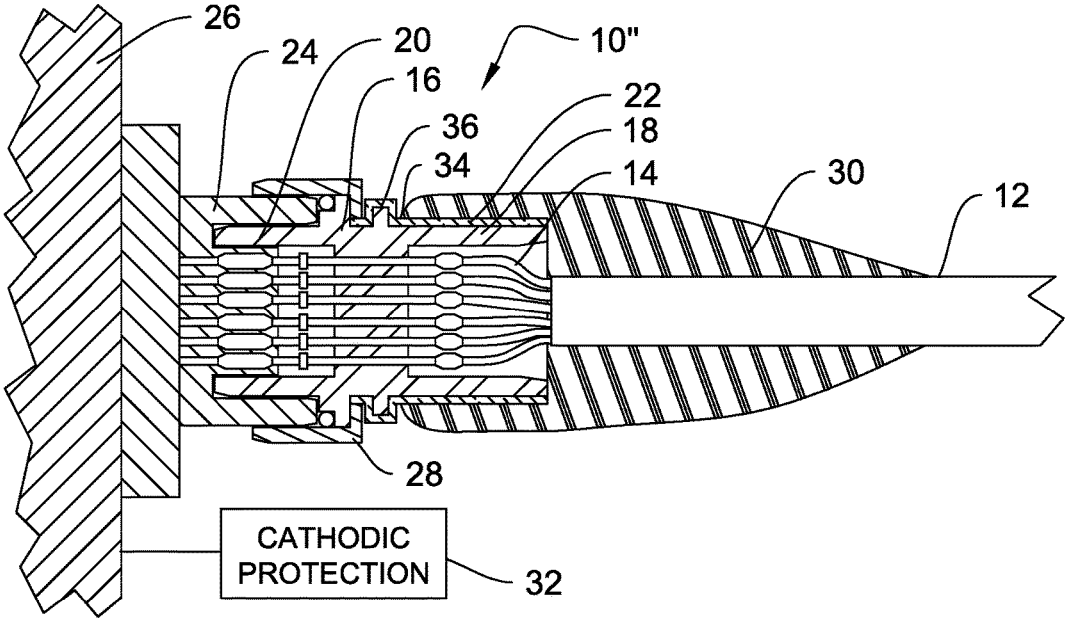
FIG. 3 is a diagram showing a second embodiment of a connector protected against cathodic debonding.

FIG. 3 shows another embodiment. Diffusion distance d does not need to be in a straight line from a hydroxide ion source. In this embodiment, connector 10" includes a flange 36 positioned around back shell portion 18. Flange 36 is covered with a non-conductive coating 22 so that it will not be a hydroxide ion source. For hydroxide ions to reach bond-line/interface 34, they must travel from the locking ring 28, across the top of flange 36, and radially inward to interface 34. The region across the top of flange 36 is expected to have greater turbulence thereby subjecting hydroxide ions to dilution and lowering the pH at interface 34.

Figure 4:
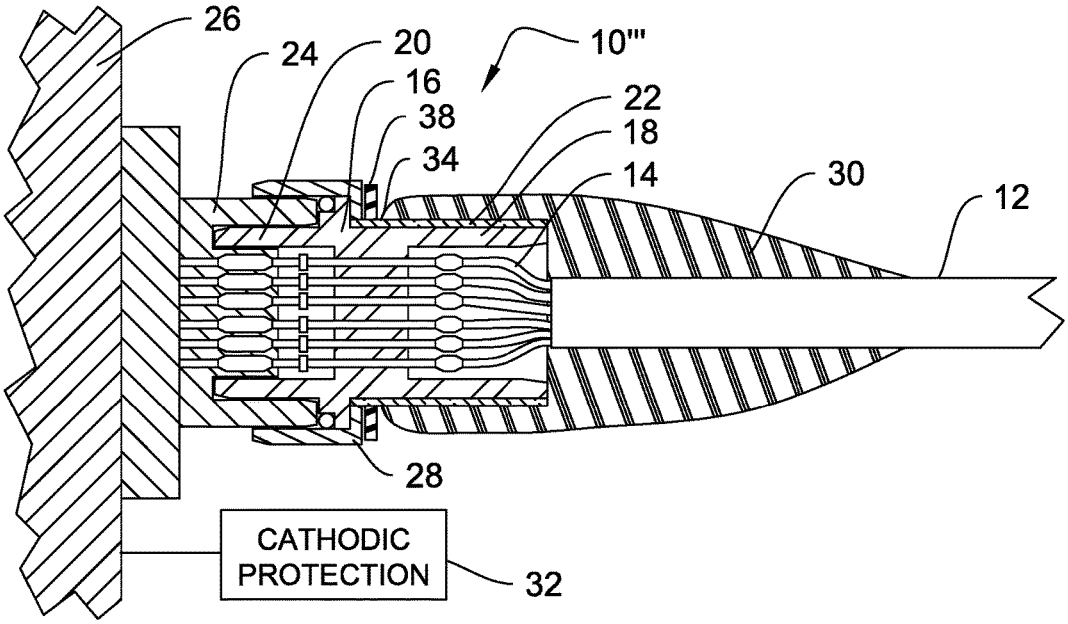
FIG. 4 is a diagram showing a third embodiment of a connector protected against cathodic debonding.

FIG. 4 shows another embodiment, further illustrating apparatus for utilizing the teachings herein. Connector 10" features an anti-diffusion collar 38 positioned between locking ring 28 and interface 34. Anti-diffusion collar 38 can be a non-conductive member that is sealed against the non-conductive coating 22 around back shell portion 18. Anti-diffusion collar 38 can be made from an elastomeric material that is positioned around back shell portion 18 prior to the assembly of connector 10''' to cable 12. Anti-diffusion collar 38 can be heat shrunk to seal against back-shell portion 18 or can be stretched over back shell portion 18. Encapsulant 30 can be molded around back shell portion 18 and cable 12 after positioning of the anti-diffusion collar 38 and assembly of the cable 12 in connector 10'''. In operation, anti-diffusion collar 38 will extend radially outward away from interface 34 to provide the distance d. It is expected that this will reduce the concentration of hydroxide ions that are communicated from cathodically protected components to interface 34.

It will be understood that these teachings can be applied to many different types of connectors and the descriptions herein are merely for illustrative purposes. There may be many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive, nor to limit the invention to the precise form disclosed; and obviously, many modification and variations are possible in light of the above teaching. Such modifications and variations that may be apparent to a person skilled in the art are intended to be included within the scope of this invention as defined by the accompanying claims.

What is claimed is:

1. A method for improving service life in a connector for joining to a cathodically protected platform comprising the steps of:

providing a cable;

providing a metallic connector having a non-conductive coating on a portion thereof wherein exposed cathodically protected portions of the metallic connector are hydroxide ion sources;

assembling the cable in the metallic connector;

determining a hydroxide ion diffusion distance away from the exposed cathodically protected portions of the metallic connector as the distance that will dilute hydroxide ions for reducing cathodic delamination; and molding a polymer encapsulant around the cable and the non-conductive coating on the metallic connector forming a polymer encapsulant and non-conductive coating bond therebetween to seal the assembled cable in the metallic connector such that the polymer encapsulant and non-conductive coating bond is formed at a greater distance than the determined hydroxide ion diffusion distance from exposed cathodically protected portions of the metallic connector;

wherein the step of providing a metallic connector having a non-conductive coating further comprises providing a raised region around the metallic connector underneath the non-conductive coating proximate exposed cathodically protected portions of the metallic connector such that the raised region in combination with the non-conductive coating and the distance between the exposed cathodically protected portions of the metallic connector and the polymer encapsulant and non-conductive coating bond is at least the determined hydroxide ion diffusion distance.

2. A method for improving service life in a connector for joining to a cathodically protected platform comprising the steps of:

providing a cable;

providing a metallic connector having a non-conductive coating on a portion thereof wherein exposed cathodically protected portions of the metallic connector are hydroxide ion sources;

providing a non-conductive ring around the metallic connector and the non-conductive coating and sealed there against between exposed cathodically protected portions of the metallic connector and the encapsulant mounting portion;

assembling the cable in the metallic connector;

determining a hydroxide ion diffusion distance away from the exposed cathodically protected portions of the metallic connector as the distance that will dilute hydroxide ions for reducing cathodic delamination; and molding a polymer encapsulant around the cable and the non-conductive coating on the metallic connector forming a polymer encapsulant and non-conductive coating bond therebetween to seal the assembled cable in the metallic connector such that the polymer encapsulant and non-conductive coating bond is formed at a greater distance than the determined hydroxide ion diffusion distance from exposed cathodically protected portions of the metallic connector.

3. The method of claim 2 wherein the non-conductive zing is provided on the non-conductive coating by heat shrink fitting.

4. The method of claim 2 wherein the non-conductive ring is made from an elastomeric material, and the non-conductive ring is provided on the non-conductive coating by elastically expanding the ring and allowing the ring to contract around the non-conductive coating.

5. The method of claim 2 wherein the determined hydroxide ion diffusion distance is at least about 0.5 inches.

6. A delamination resistant marine connector for joining an existing cable to a cathodically protected outlet comprising:

a metallic connector body having a terminal portion connecting to the cathodically protected outlet and a back shell portion capable of receiving the existing cable therein;

a non-conductive coating disposed on said metallic connector body back shell portion, other metallic portions of said metallic connector body remaining exposed; and an encapsulant molded around said non-conductive coating and the existing cable and bonded thereto such that said encapsulant is molded a distance from the other metallic portions of said metallic connector body remaining exposed to prevent concentrated hydroxide ions from eroding the bonded region between said encapsulant and said non-conductive coating;

wherein said metallic connector body back shell portion has a flange formed there around and coated by said non-conductive coating, the flange being provided to increase the distance between said encapsulant and the other metallic portions of said metallic connector body remaining exposed.

7. The apparatus of claim 6 wherein said encapsulant is molded around said non-conductive coating and said metallic connector body back shell portion at least 0.5 inches from the other metallic portions of staid metallic connector body remaining exposed.

8. A delamination resistant marine connector for joining an existing cable to a cathodically protected outlet comprising:

a metallic connector body having a terminal portion connecting to the cathodically protected outlet and a back shell portion capable of receiving the existing cable therein;

a non-conductive coating disposed on said metallic connector body back shell portion, other metallic portions of said metallic connector body remaining exposed;

an anti-diffusion collar made from a non-conductive material and sealed against said non-conductive coating on said metallic connector body back shell portion between said encapsulant and the other metallic portions of said metallic connector body remaining exposed; and an encapsulant molded around said non-conductive coating and the existing cable and bonded thereto such that said encapsulant is molded a distance from the other metallic portions of said metallic connector body remaining exposed to prevent concentrated hydroxide ions from eroding the bonded region between said encapsulant and said non-conductive coating.

9. The apparatus of claim 8 wherein said encapsulant is molded around said non-conductive coating and said metallic connector body back shell portion at least 0.5 inches from the other metallic portions of said metallic connector body remaining exposed.

* * * * *